United States Patent [19]

Illing et al.

[11] Patent Number: 5,064,096

[45] Date of Patent: Nov. 12, 1991

[54] TANK LINER-TO-OUTLET NECK SEAL

[75] Inventors: Peter A. Illing; Phillip L. Lanier; Reginald W. Ensminger, all of West Monroe, La.

[73] Assignee: Shield Pack, Inc., West Monroe, La.

[21] Appl. No.: 560,991

[22] Filed: Aug. 1, 1990

[51] Int. Cl.[5] ..... B65D 35/56

[52] U.S. Cl. ..... 222/105; 222/185; 222/542

[58] Field of Search ..... 222/105, 106, 107, 183, 222/542, 563, 185

[56] References Cited

U.S. PATENT DOCUMENTS

| | | | |
|---|---|---|---|
| 1,450,055 | 3/1923 | Trumbull | 222/105 |
| 2,090,403 | 8/1937 | Murray et al. | 222/183 |
| 2,657,834 | 11/1953 | Bacheller | 222/542 |
| 2,815,887 | 12/1957 | Ford et al. | 222/107 |
| 2,831,610 | 4/1958 | Dennie | 222/183 |
| 3,081,911 | 3/1963 | Scholle | 222/105 |
| 3,086,679 | 4/1963 | Bijvoet | 220/63 |
| 3,151,787 | 10/1964 | Miller | 222/542 |
| 3,169,690 | 2/1965 | Scholle | 220/403 |
| 3,675,819 | 7/1972 | Hanson | 222/183 |
| 3,837,533 | 9/1974 | Splan | 222/105 |
| 4,165,024 | 8/1979 | Oswalt et al. | 222/105 |
| 4,314,768 | 2/1982 | Goglio et al. | 222/105 |
| 4,635,814 | 1/1987 | Jones | 220/403 |
| 4,700,867 | 10/1987 | Dutt et al. | 220/410 |
| 4,723,688 | 2/1988 | Munoz | 222/105 |
| 4,771,917 | 9/1988 | Heaps, Jr. et al. | 222/92 |
| 4,921,136 | 5/1990 | Roggenberg, Jr. | 222/183 |
| 4,960,227 | 10/1990 | Coleman | 222/105 |

FOREIGN PATENT DOCUMENTS

| | | | |
|---|---|---|---|
| 949858 | 9/1949 | France | 222/563 |
| 226975 | 1/1925 | United Kingdom | 222/563 |

*Primary Examiner*—Michael S. Huppert
*Assistant Examiner*—Kenneth Bomberg
*Attorney, Agent, or Firm*—Fleit, Jacobson, Cohn, Price, Holman & Stern

[57] ABSTRACT

A rigid open top tank is provided having a centrally located bottom wall gravity drain outlet neck provided with a flow control valve downstream from the tank bottom wall. An open top thin, flexible plastic liner is placed within the tank through the open top thereof and includes a downwardly opening gravity discharge nipple which is removably telescoped downwardly into and sealingly secured relative to the inlet end of the outlet neck.

5 Claims, 1 Drawing Sheet

FIG. 1
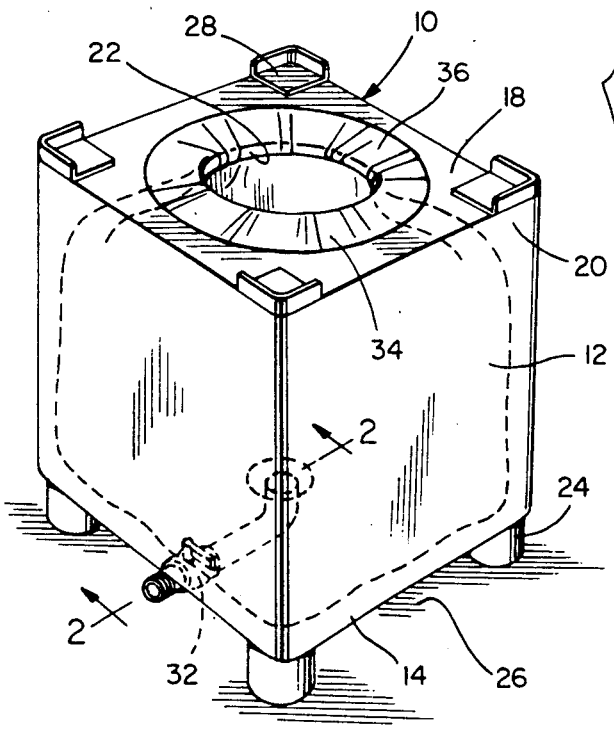
FIG. 3
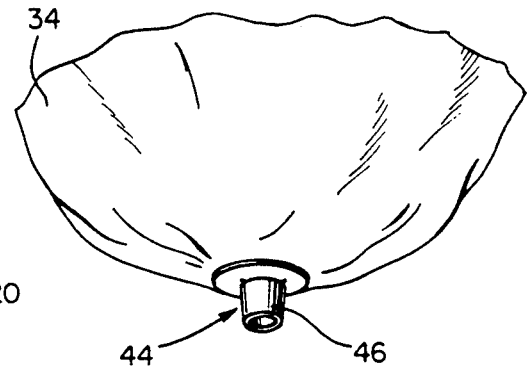
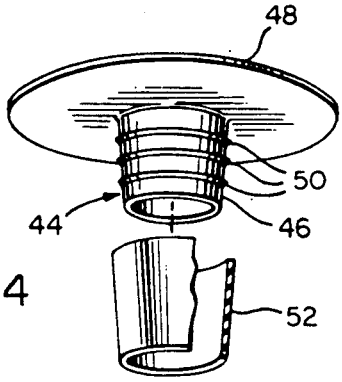
FIG. 4
FIG. 2
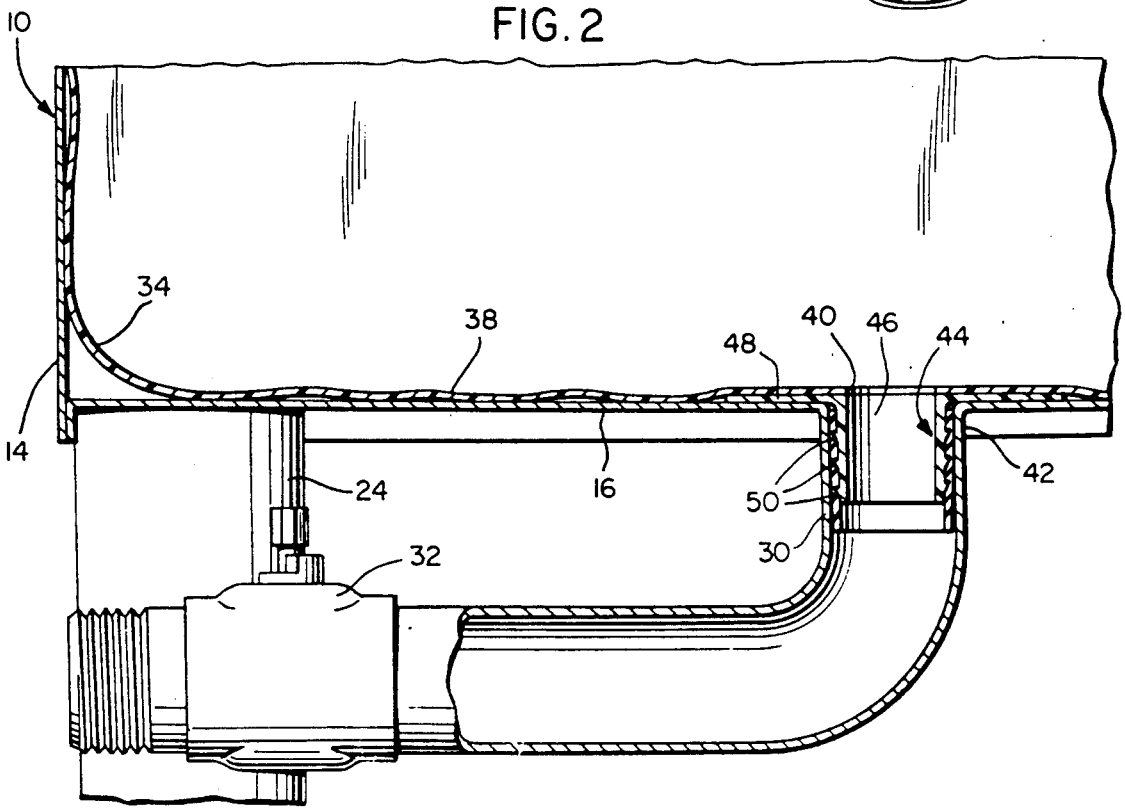

TANK LINER-TO-OUTLET NECK SEAL

BACKGROUND OF THE INVENTION

1. Field of the Invention

This invention relates to a method and apparatus for protectively lining the interior of a hazardous material tank equipped with a gravity discharge neck incorporating a control valve at its discharge end and wherein the liner for the tank comprises a flexible plastic liner having a gravity outlet nipple therefore downwardly telescoped into and sealingly secured relative to the outlet neck of the tank upstream from the control valve thereof.

2. Description of Related Art

Various different forms of lined receptacles, sleeved containers and shipping containers heretofore have been provided for hazardous and non-hazardous materials. Examples of these previously known devices are disclosed in U.S. Pat. Nos. 3,086,679, 3,169,690, 4,635,814, 4,700,867 and 4,771,917. However, these previously known constructions do not include the overall combination of structural and operational features incorporated in the instant invention.

SUMMARY OF THE INVENTION

The instant invention incorporates a rigid tank construction including an upper access opening and a bottom wall gravity flow outlet neck provided with a valve on its outlet end. A thin, flexible plastic liner is disposed and confined within the tank and includes a semi-rigid gravity flow outlet nipple in the bottom thereof which projects downwardly into the outlet neck of the tank and a rubber-like sealing sleeve is telescoped over the nipple and downwardly into the outlet neck with the sleeve radially compressed between the external surfaces of the nipple and the internal surfaces of the outlet neck to thereby form a fluid tight seal therebetween such that head pressure of liquid within the liner may not cause back flow linkage of the liquid between the internal surfaces of the outlet neck and the external surfaces of the liner nipple and thus flow of the liquid into the interior of the tank externally of the liner.

The main object of this invention is provide a method and apparatus of transporting hazardous and non-hazardous liquids within a reusable transport tank in a manner eliminating the need for cleansing the internal surfaces of the tank between shipments of liquid therein.

Another object of this invention is to provide a method and apparatus of transporting hazardous liquids in reusable tanks that will greatly reduce the costs incident to such transport of liquids and which will greatly reduce the volume of hazardous material contaminated cleaning liquids which must be used to clean such reusable tanks between shipment of hazardous material liquids therein.

Yet another object of this invention is to provide a method and apparatus in accordance with the preceding objects and which may be practiced in conjunction with reusable shipping tanks of various sizes and shapes.

A final object of this invention to be specifically enumerated herein is to provide a method and apparatus in accordance with the preceding objects and which will conform to conventional forms of manufacture, be of simple construction and easy to use so as to be economically feasible, long-lasting and relatively trouble free.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of a typical form of hazardous materials shipping tank incorporating the liner of the instant invention;

FIG. 2 is an enlarged fragmentary vertical sectional view taken substantially upon the plane indicated by the section line 2—2 of FIG. 1;

FIG. 3 is a fragmentary bottom perspective view of the liner for the shipping tank illustrating the tapered outlet nipple thereof; and FIG. 4 is an enlarged exploded perspective of the liner outlet nipple and the associated seal sleeve to be used in conjunction therewith, parts of the seal sleeve being broken away and illustrated in vertical section.

DESCRIPTION OF THE PREFERRED EMBODIMENT

Referring now more specifically to the drawings the numeral 10 generally designates a typical form of reusable shipping tank for hazardous materials. The shipping tank 10 includes peripherally extending side walls 12 having lower margins 14 interconnected by a bottom wall 16 extending and secured between the lower margins 14 and the tank 10 additionally includes a top wall 18 extending and secured between upper margins 20 of the side walls 12 and including a central opening 22 therein.

The tank 10 is generally square in plan shape and includes four corner depending feet 24 whereby the tank may be supported from a support surface 26 with the bottom 16 elevated above the surface 26 and the four corners of the top wall 18 include reinforcement plates 28 supported therefrom adapted to have the lower ends of feet 24 of a second tank 10 disposed thereabove positioned thereon.

The bottom wall 16 includes a rigid, tubular downwardly projecting outlet neck 30 opening upwardly into the interior of the tank 10 and including a control valve 32 at its discharge end. The valve 32 and neck 30 are disposed within the peripheral confines of the tank 10 and are spaced above the lower ends of the feet 24. Thus, the outlet 30 and valve 32 are protected against impact by adjacent articles.

A flexible liner 34 of a size and shape to be conformingly received within the interior of tank 10 is provided and the upper end of the liner 34 is open as at 36 and projects outwardly through the opening 24. The liner 34 is constructed of a suitable plastic and may be between two and twenty mil in thickness. Further, the bottom 38 of the liner 34 includes a central opening 40 registered with the inlet end 42 of the outlet neck 30 and an outlet fitting referred to in general by the reference numeral 44 is provided for the liner 34.

The fitting 44 includes an upstanding tubular nipple 46 which is downwardly tapered and includes an integral upper end flange 48 which is horizontal and diametrically enlarged. The flange 48 has its upper surface sealingly secured, in any convenient manner, to the underside of the bottom 38 of the liner 34 about the opening 40 and the nipple 46 includes a plurality of circumferentially extending and radially outwardly projecting ribs 50 which are generally saw-toothed shaped in cross section, see FIG. 2.

Also, an upstanding and downwardly tapering sealing sleeve 52 is provided and constructed of a synthetic rubber-like material. The fitting 44 may be constructed of polyethylene and, therefore, is semi-rigid. Of course, the sleeve 52 is somewhat resilient.

The liner 34 is downwardly inserted into the tank 10 through the opening 22 and the tapered sleeve 52, whose upper end could be provided with a flange such as flange 48, has its large diameter end slightly telescoped over the lower end of the nipple 46. Then, the lower end of the sleeve 52 is telescoped into the inlet end 42 of the outlet 30 and downward pressure is applied to the flange 48, whereby the nipple 46 is forced into the sleeve 52 and the sleeve 52 is forced downwardly into the inlet end 42 of the outlet neck 30 with the sleeve 52 being radially compressed between the outer surfaces of the nipple 46 and the inner surfaces of the inlet 42 of the outlet neck 30. In this manner, a fluid tight seal is formed between the nipple 46 and the internal surfaces of the inlet end portion 42 of the outlet neck 30.

Any hazardous fluent material then may be introduced into the interior of the liner 34 from open upper end 36 thereof and the upper end 36 of the liner 34 then may be sealingly closed.

The valve 32 is closed, but because of the fluid tight seal between the nipple 46 and the internal surfaces of the inlet end of the outlet neck 30 the head pressure of fluent material within the liner 34 above the bottom wall 16 is inoperative to cause the fluent material within the outlet neck 30 to backup between the nipple 46 and the internal surfaces of the inlet 42 of the outlet neck 30 and move into the area between the internal surfaces of the tank 10 and the external surfaces of the liner 34.

The tank 10 then may be shipped to a predetermined location and the fluent material therein may be drained therefrom by opening the valve 32. After the fluent material has been drained from the liner 34, the empty liner 34 may have the portion thereof disposed within the tank 10 pushed to one side and a work person may enter the interior of the tank 10 through the opening 22 and exert an upward pull on the liner and the flange 48 to upwardly withdraw the nipple 46 and sleeve 52 from within the outlet neck 30. Thereafter, the liner 34, fitting 44 and sleeve 52 are upwardly removed through the opening 22 and the interior and exterior of the outlet neck 30 may be suitable cleansed with a cleaning liquid.

Inasmuch as the interior of the tank above the inlet end of the outlet neck 30 has not been contaminated with the hazardous fluent material previously shipped in the tank 10, only a sufficient quantity of cleaning liquid need be used to clean the interior and exterior of the outlet neck 30 and valve 32, thus conserving on cleaning liquid and further greatly reducing the volume of cleaning liquid which must controllably disposed of.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination, a tank including side walls having lower margins interconnected by a bottom wall extending and secured between said lower margins, said bottom wall including a rigid, tubular downwardly projecting outlet neck, said outlet neck including a flow control means downstream from said bottom wall, a flexible plastic liner disposed in and at least generally conforming to the interior shape of said tank and including peripheral sides and an integral bottom extending between and connecting said sides, said bottom having an outlet opening therethrough registered with said outlet neck, and outlet fitting including a tubular nipple having a radially outwardly projecting flange on one end, said fitting being constructed of at least semi-rigid plastic material and having its flange disposed in lapped relation with and sealingly secured to portions of said bottom extending about said outlet opening with the other end of said nipple projecting downwardly from said bottom and into said outlet neck, and a rubber-like material sleeve tightly telescoped over said nipple and tightly wedgingly telescoped into said outlet neck with said sleeve radially compressed between the outer surfaces of said nipple and the inner surfaces of said outlet neck to form a fluid tight seal between said nipple and outlet neck, said nipple and sleeve being slightly downwardly tapered, said flange underlying said portions of said bottom extending about said opening.

2. The combination of claim 1 wherein said nipple includes circumferentially extending exterior surface ribbed means conformably deforming the inner surface of said sleeve.

3. The combination of claim 2 wherein said exterior surface ribbed means includes at least two axially spaced and circumferentially extending ribs.

4. The combination of claim 3 wherein said ribs are generally saw-toothed shaped in cross section for ease of downward insertion of said nipple into said sleeve and relatively difficult upward removal of said nipple from said sleeve.

5. A method of shipment of fluent hazardous materials, said method comprising:

A. providing a rigid, reusable and upwardly, opening shipping tank including side walls having lower margins interconnected by a bottom wall extending and secured between said lower margins and with said bottom wall including a rigid, tubular downwardly projecting outlet neck opening upwardly into said tank and including flow control means downstream from said bottom wall;

B. providing a flexible plastic open top liner for said tank including peripheral sides and an integral bottom extending between and connecting said sides and with said bottom having a central outlet opening therein and including a gravity discharge and downwardly tapering and projecting semi-rigid tubular nipple incorporating an annular upper end flange underlying and sealingly secured to the underside of said bottom about said outlet opening;

C. providing a rubber-like, downwardly tapered sealing sleeve partially telescoped over said nipple;

D. downwardly displacing said liner into said tank into position with the sleeve partially downwardly telescoped into the outlet neck;

E. forcibly downwardly wedging said nipple into said sleeve and said sleeve into said outlet neck from within said tank by applying downward pressure on said flange to thereby form a fluid tight seal between said nipple and said outlet neck;

F. placing a desired quantity of hazardous fluent material within said liner through the open upper end thereof;

G. sealing closed the top of said liner;

H. shipping said tank and sealed liner with said material therein to a predetermined location;

I. gravity draining said fluent material from said liner through said outlet neck and said flow control means;

J. upwardly removing said liner, including said nipple and said sleeve, from said tank;

K. thoroughly cleaning the interior and exterior of said outlet neck with a minimum amount of cleaning liquid.

* * * * *